US006267180B1

(12) United States Patent
Gazda et al.

(10) Patent No.: US 6,267,180 B1
(45) Date of Patent: Jul. 31, 2001

(54) PACKER RELEASING TOOL AND METHOD FOR RELEASING A PACKER ASSEMBLY FROM A WELLBORE

(75) Inventors: Imre I. Gazda, Fort Worth; Marion D. Kilgore, Dallas; Dennis D. Rood, Carrollton, all of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/139,365

(22) Filed: Aug. 25, 1998

(51) Int. Cl.[7] ..... E21B 23/00; E21B 31/20

(52) U.S. Cl. ..... 166/301; 166/98; 166/237; 166/387; 294/86.25

(58) Field of Search ..... 166/98, 237, 301, 166/387; 294/86.1, 86.24, 86.25

(56) References Cited

U.S. PATENT DOCUMENTS

| | | | | |
|---|---|---|---|---|
| 3,746,093 | * | 7/1973 | Mullins | 166/237 X |
| 3,851,708 | * | 12/1974 | Ellis | 166/237 |
| 3,874,446 | * | 4/1975 | Crowe | 166/237 X |
| 4,438,811 | | 3/1984 | Patel | 166/123 |
| 4,671,354 | | 6/1987 | Henderson et al. | 166/134 |
| 4,793,411 | * | 12/1988 | Zunkel | 166/98 |
| 4,842,082 | * | 6/1989 | Springer | 166/98 X |
| 5,074,361 | * | 12/1991 | Brisco et al. | 166/301 |
| 5,082,062 | * | 1/1992 | Wood et al. | 166/237 X |
| 5,103,902 | | 4/1992 | Ross et al. | 166/120 |
| 5,311,938 | | 5/1994 | Hendrickson et al. | 166/134 |
| 5,343,954 | * | 9/1994 | Bohlen et al. | 166/237 X |
| 5,641,023 | | 6/1997 | Ross et al. | 166/386 |
| 5,692,564 | * | 12/1997 | Brooks | 166/127 |

* cited by examiner

*Primary Examiner*—George Suchfield
(74) *Attorney, Agent, or Firm*—Paul I. Herman; Charles W. Gaines

(57) ABSTRACT

The present invention provides a packer releasing tool for releasing a packer from a wellbore where the packer is coupled to a tubing string and has a releasing profile with a packer uphole shoulder and a packer downhole shoulder. The packer releasing tool preferably comprises a toplock assembly removably coupled to a downlock assembly. It also includes a toplock key that is movably coupled to the toplock assembly and that has a toplock key profile engageable against the packer releasing profile. Also present is a downlock lug that is movably coupled to the downlock assembly and that has a downlock lug profile engageable against the packer releasing profile. In one embodiment, the packer releasing tool has an outer diameter that is less than the inner diameter of the tubing string. This unique configuration allows the packer to be pulled without the need of first removing the production string.

63 Claims, 12 Drawing Sheets

PACKER RELEASING TOOL AND METHOD FOR RELEASING A PACKER ASSEMBLY FROM A WELLBORE

TECHNICAL FIELD OF THE INVENTION

The present invention is directed, in general, to a system for use in a subterranean wellbore, and more specifically to a packer releasing tool and system for releasing a packer from a wellbore.

BACKGROUND OF THE INVENTION

In the course of testing and preparing subterranean oil and gas wells for production, a well packer is run into the well on a work string or production tubing. The packer is used: (a) to support the production tubing and the other completion equipment such as filter screens adjacent to a producing formation, and (b) to seal the annulus between the outside of the production tubing and the inside of the well casing, thus blocking movement of fluids through the annulus past the packer location. The packer is equipped with anchor slips that have opposed camming surfaces that cooperate with complementary opposed wedging surfaces. The anchor slips are radially extendable into gripping engagement against the well casing bore in response to relative axial movement of the wedging surfaces. The packer also carries annular seal elements that are expandable radially into sealing engagement against the bore of the well casing in response to axial compression forces. Hydraulic or mechanical means may be used to set the anchor slips and the sealing elements.

After the packer has been set and sealed against the well casing bore, it is designed to maintain the seal after the hydraulic or mechanical setting force is removed. It is absolutely essential that the packer remain locked in its set and sealed configuration while withstanding hydraulic pressures that may be applied from the formation and/or the manipulation of the tubing string and service tools. In deep wells this may be much more difficult as the packer and its components are subjected to downhole temperatures as high as 600° F., and downhole pressures of up to 10,000 psi. Moreover, the packer should be able to withstand the application of external hydraulic pressures at levels up to as much as 10,000 psi in either direction, and still be retrievable after exposure for periods of 10 to 15 years or more. After such long periods of extended service under extreme pressure and temperature conditions, it is desirable that the packer be retrievable from the well. Appropriate manipulation of the tubing string must cause the packer to be released and unsealed from the well bore, with the anchor slips and seal elements being retracted sufficiently to avoid seizure against well bore restrictions that are smaller than the retracted seal assembly, for example, at a makeup union, collar union, nipple, etc.

Currently, permanent and retrievable packers are used for long-term placement in high temperature, high pressure wells. While so-called permanent packers exist, most are still designed to be retrievable through some form of manipulation to release the packer elements and anchor slips, with the packer then to be removed from the well bore. However, since the packers are threaded into the production tubing and are held in firm contact with the well casing, the problem of how to retrieve them occurs. Conventionally, retrievable packers have been removed from the well by first removing all of the production tubing from a threaded joint at the top of the packer to be removed. Then, a new work string with a releasing tool attached is introduced into the well. The releasing tool attaches to the threaded coupling on the top of the packer and operates the release mechanism of the packer. The packer is then retrieved by a tensile force applied to the work string transferred to the packer at the threaded coupling. However, the extra operation of removing the production tubing from above the packer before the packer can be released and retrieved is expensive in time and manpower to accomplish.

Therefore, what is needed in the art is a slick line packer release system that simplifies the locating, release and retrieval of a set packer without removing the production tubing.

SUMMARY OF THE INVENTION

To address the above-discussed deficiencies of the prior art, the present invention provides a packer releasing tool for releasing a packer from a wellbore where the packer is coupled to a tubing string and has a releasing profile with a packer uphole shoulder and a packer downhole shoulder. In one embodiment, the packer releasing tool comprises a toplock assembly that is movably coupled to a downlock assembly and a toplock key that is movably coupled to the toplock assembly and that has a toplock key profile engageable against the packer releasing profile. This embodiment further includes a downlock lug that is movably coupled to the downlock assembly and that has a downlock lug profile engageable against the packer releasing profile. In one preferred embodiment, the packer releasing tool has an outer diameter that is less than the inner diameter of the tubing string. This unique configuration allows the packer to be released without the need of first removing the production string.

In another embodiment, the toplock key includes an inner profile and the toplock assembly further comprises a running profile configured to cooperatively engage the inner profile and receive the toplock key therein as the packer releasing tool is run into the wellbore. In another aspect of this particular embodiment, the toplock assembly further comprises a pulling profile configured to cooperatively engage the inner profile and receive the toplock key therein when the packer releasing tool is pulled from the wellbore. In another aspect of this particular embodiment, the toplock assembly further comprises a toplock carrier and a mandrel. The toplock carrier is movable with respect to the mandrel, and the toplock assembly further includes a key releasing shear pin coupling the toplock carrier to the mandrel. The key releasing shear pin limits the range of motion of the toplock carrier with respect to the mandrel. In yet another aspect of this particular embodiment, the mandrel includes a mandrel stop shoulder and the toplock carrier includes a carrier shoulder configured to engage the mandrel stop shoulder and prevent a movement of the toplock carrier with respect to the mandrel. The packer releasing tool may further comprise a toplock assembly spring configured to exert a downhole force against the toplock carrier and move the toplock carrier downhole with respect to the mandrel to allow the inner profile of the key to engage the pulling profile when the key releasing shear pin is sheared.

In another embodiment, the toplock assembly is removably coupled to the downlock assembly by an assembly shear pin. The shear pin is preferably configured to shear when a sufficient amount of force is exerted against the shear pin, which allows the toplock assembly to separate from the downlock assembly.

In another embodiment, the downlock assembly includes a downlock lug running profile configured to cooperatively receive the downlock lug therein as the packer releasing tool is run into the wellbore. The toplock key profile may further include a toplock key uphole stop shoulder configured to engage the packer uphole shoulder and a toplock key downhole stop shoulder configured to engage the packer downhole shoulder. In another embodiment, the downlock lug profile includes a downlock lug uphole stop shoulder configured to engage the packer uphole shoulder and a downlock lug downhole stop shoulder configured to engage the packer downhole shoulder.

In a further embodiment, the packer releasing tool comprises an extension rod extending through the toplock assembly and the downlock assembly. The extension rod is movable with respect to the toplock assembly and engageable against the downlock assembly to separate the downlock assembly from the toplock assembly. In another aspect of this particular embodiment, a downhole power unit is coupled to the extension rod and is configured to exert a downhole force against the downlock assembly by way of the extension rod. In yet another aspect of this particular embodiment, the packer releasing tool further comprises an extension rod retainer coupled to the extension rod, a spring guide having a spring guide shoulder and positioned about the extension rod retainer. The spring guide is coupled to the downlock assembly, and the extension rod extends through the extension rod retainer and the spring guide. The extension rod retainer is movable with respect to the spring guide. This particular embodiment further includes a downlock assembly spring wherein the downlock assembly spring is positioned about the spring guide and captured between the spring guide shoulder and the downlock assembly.

In another aspect of this particular embodiment, the downlock assembly further comprises a cone assembly having an uphole portion and a downhole portion. The spring guide is coupled to the cone assembly adjacent the downhole portion of the cone assembly, and the downhole portion of the cone assembly includes a spring guide stop shoulder. This embodiment of the downlock assembly also includes a downlock lug cage that is movably coupled to the cone assembly and that has a bumper stop shoulder. The spring guide shoulder is engageable against the spring guide stop shoulder to capture the downlock assembly spring between the downlock lug cage and the spring guide shoulder. A bumper assembly is also present in this particular embodiment. The bumper assembly has a bumper coupled to collet members positioned about the downhole portion of the cone assembly. The bumper is engageable against the bumper stop shoulder.

In another aspect of the present invention, a system for releasing a packer from a wellbore is provided. In one preferred embodiment, the system comprises a packer that is coupled to a tubing string and that has a packer releasing profile with a packer uphole shoulder and a packer downhole shoulder. The system also includes a packer releasing tool as previously discussed, including its various embodiments. Preferably, the packer releasing tool includes a toplock assembly that is removably coupled to a downlock assembly. A toplock key that is movably coupled to the toplock assembly and that has a toplock key profile engageable against the packer releasing profile is also present in this embodiment. Also present is a downlock lug that is movably coupled to the downlock assembly and that has a downlock lug profile engageable against the packer releasing profile. The packer releasing tool has an outer diameter that is less than an inner diameter of the tubing string such that it may pass through the tubing string. This embodiment also includes a downhole power unit couplable to the packer releasing tool.

The packer preferably includes packer seals and packer slips engageable against an inner diameter of the wellbore. The packer may also include a snap ring and a snap ring mandrel. The snap ring mandrel preferably has a slidable packer sleeve associated therewith to maintain the snap ring in a retracted position. In a preferred embodiment, the snap ring is configured to maintain the packer seal and packer slips in an engaged position against the inner diameter of the wellbore when the snap ring is in the retracted position.

In yet another embodiment, the packer releasing tool is engageable against the uphole shoulder to shift the packer sleeve with respect to the snap ring to allow the snap ring to move from the retracted position to a release position and allow the packer seal and the packer slips to disengage from the inner diameter of the wellbore.

In yet another aspect of the present invention, a method for releasing a packer from a wellbore is provided. The packer is coupled to a tubing string and has a packer releasing profile with a packer uphole shoulder and a packer downhole shoulder. The method comprises the steps of positioning a packer releasing tool within a packer positioned in a wellbore, wherein the packer releasing tool has a toplock assembly removably coupled to a downlock assembly, engaging a toplock key profile of the toplock assembly against the packer releasing profile, engaging a downlock lug profile of the downlock assembly against the packer releasing profile, and releasing the packer from the wellbore.

The foregoing has outlined, rather broadly, preferred and alternative features of the present invention so that those who are skilled in the art may better understand the detailed description of the invention that follows. Additional features of the invention that are described hereinafter form the subject of the claims of the invention. Those who are skilled in the art should appreciate that they can readily use the disclosed conception and specific embodiment as a basis for designing or modifying other structures for carrying out the same purposes of the present invention. Those who are skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
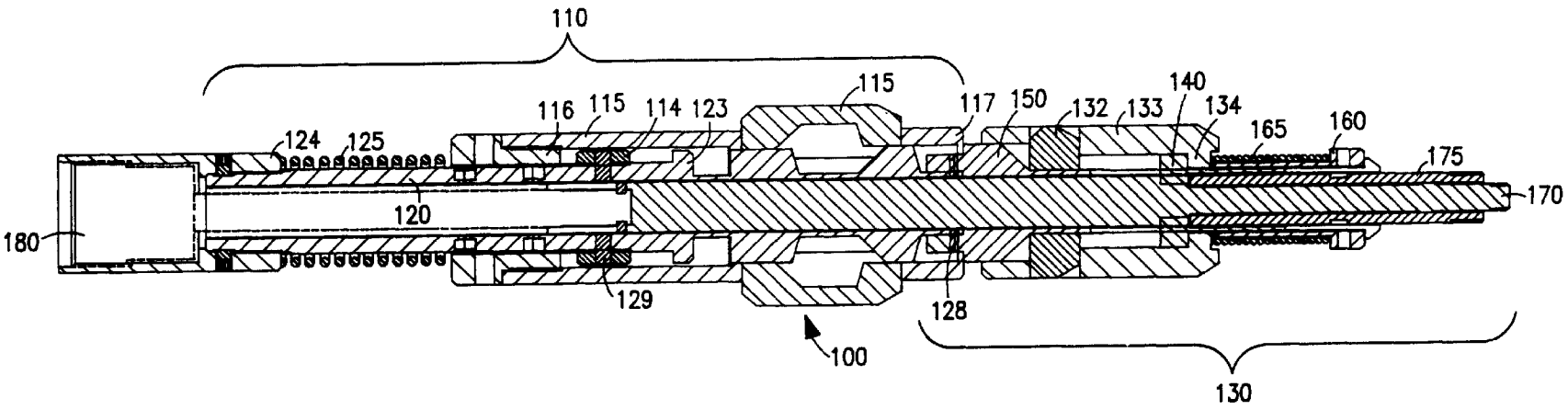
FIG. 1 illustrates a cross-sectional view of one embodiment of a packer releasing tool constructed according to the principles of the present invention.

Referring initially to FIG. 1, illustrated is a cross-sectional view of one embodiment of a packer releasing tool constructed according to the principles of the present invention. A packer releasing tool, generally designated 100, comprises a toplock assembly 110, a downlock assembly 130, an extension rod 170, and a downhole power unit 180. In a preferred embodiment, the extension rod 170 extends through the toplock assembly 110 and the downlock assembly 130 with the toplock assembly 110 coupled to the downlock assembly 130 by a plurality of assembly shear pins 128. The extension rod 170 is movable with respect to the toplock assembly 110 and is engageable against the downlock assembly 130 to separate the downlock assembly 130 from the toplock assembly 110. In this embodiment, the downhole power unit 180 is coupled to the extension rod 170 and is configured so that the downhole power unit 180 can exert a downhole force against the downlock assembly 130 by way of the extension rod 170.

In a preferred embodiment, the toplock assembly 110 comprises a plurality of toplock keys 111, a toplock key carrier 115, a mandrel 120, a toplock assembly spring 125, a shear ring 114, and a plurality of key releasing shear pins 129. The toplock keys 111 are movably coupled to the toplock assembly 110 and ride in the toplock key carrier 115. The toplock carrier 115 includes a carrier shoulder 116 and a carrier stop shoulder 117. The toplock mandrel 120 includes a mandrel stop shoulder 123. The shear ring 114 is located radially about the toplock mandrel 120 and interposed between the carrier shoulder 116 and the mandrel stop shoulder 123. In this embodiment, the plurality of key releasing shear pins 129 holds the shear ring 114 and toplock mandrel 120 in a fixed positional relationship. The mandrel 120 further includes a toplock spring stop shoulder 124. The toplock assembly spring 125 is located about the mandrel 120 and is captured between the toplock spring stop shoulder 124 and the uphole end of the toplock carrier 115.

In a preferred embodiment, the downlock assembly 130 comprises a downlock cone assembly 150, a plurality of downlock lugs 132, a downlock lug cage 133, a bumper assembly 140, a downlock spring guide 160, and a downlock spring 165. The downlock lugs 132 are movably coupled to the downlock assembly 130. The downlock lug cage 133 includes a bumper stop shoulder 134. The extension rod 170 comprises an extension rod retainer 175 located about and coupled to the extension rod 170.

For the purposes of clarity and brevity during the remainder of this discussion, further references to tool parts and surfaces will be made in the singular. However, one skilled in the art will readily understand that a given tool part so named is, in many instances, a plurality of such parts.

Figure 2A:
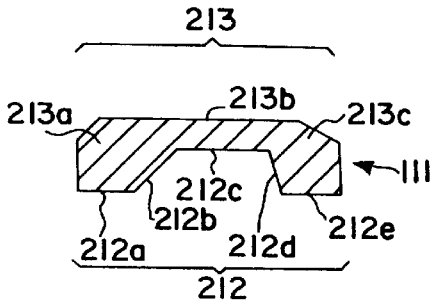
FIG. 2A illustrates a cross-sectional view of the toplock key of FIG. 1.

Referring now to FIG. 2A, illustrated is a cross-sectional view of the toplock key of FIG. 1. In a preferred embodiment, the toplock key 111 has an inner profile 212 and an outer profile 213. The toplock key inner profile 212 comprises five surfaces 222*a*, 212*b*, 212*c*, 212*d*, and 212*e*. The outer profile 213 comprises a toplock key uphole stop shoulder 213*a*, a toplock key outer surface 213*b*, and a toplock key downhole stop shoulder 213*c*.

Figure 2B:
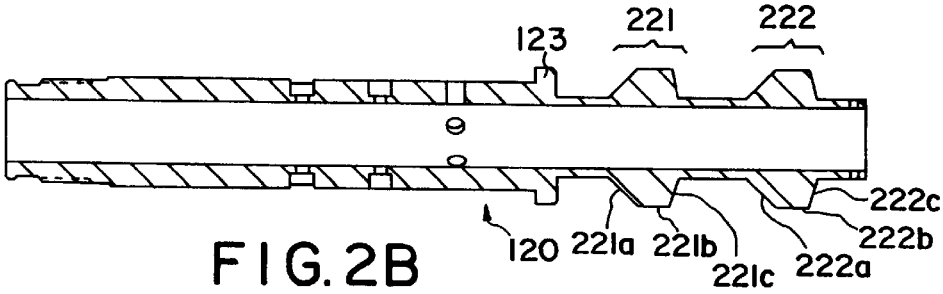
FIG. 2B illustrates a cross-sectional view of the mandrel of FIG. 1.

Referring now to FIG. 2B, illustrated is a cross-sectional view of the mandrel of FIG. 1. In a preferred embodiment, the toplock mandrel 120 further includes a running profile 221, and a pulling profile 222. The running profile 221 comprises three surfaces 221*a*, 221*b*, and 221*c*. Likewise, the pulling profile 222 comprises three surfaces 222*a*, 222*b*, and 222*c*.

Figure 2C:
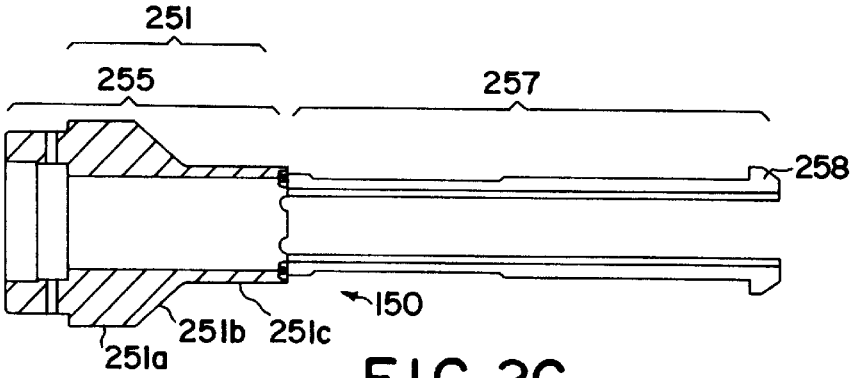
FIG. 2C illustrates a cross-sectional view of the cone assembly of FIG. 1.

Referring now to FIG. 2C, illustrated is a cross-sectional view of the cone assembly of FIG. 1. In a preferred embodiment, the cone assembly 150 comprises an uphole portion 255 and a downhole portion 257. The uphole portion 255 comprises an outer profile 251 with three surfaces 251*a*, 251*b*, and 251*c*. The downhole portion 257 comprises a spring guide stop shoulder 258.

Figure 2D:
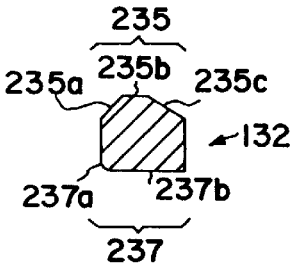
FIG. 2D illustrates a cross-sectional view of the downlock lug of FIG. 1.

Referring now to FIG. 2D, illustrated is a cross-sectional view of the downlock lug of FIG. 1. In a preferred embodiment, the downlock lug 132 has an outer downlock lug profile 235 and an inner downlock lug profile 237. The outer downlock lug profile 235 comprises a downlock lug uphole stop shoulder 235*a*, a downlock lug outer surface 235*b*, and a downlock lug downhole stop shoulder 235*c*. The inner downlock lug profile 237 comprises two surfaces 231*a* and 237*b*.

Figure 2E:
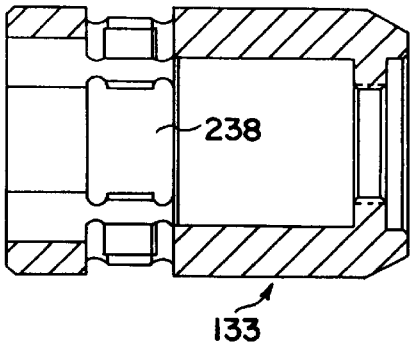
FIG. 2E illustrates a cross-sectional view of the downlock cage of FIG. 1.

Referring now to FIG. 2E with continuing reference to FIG. 2C, illustrated is a cross-sectional view of the downlock cage of FIG. 1. The downlock assembly 130 includes a downlock lug running profile preferably comprising the cone assembly surface 251*c* and a downlock lug aperture 238 in the downlock lug cage 133.

Figure 2F:
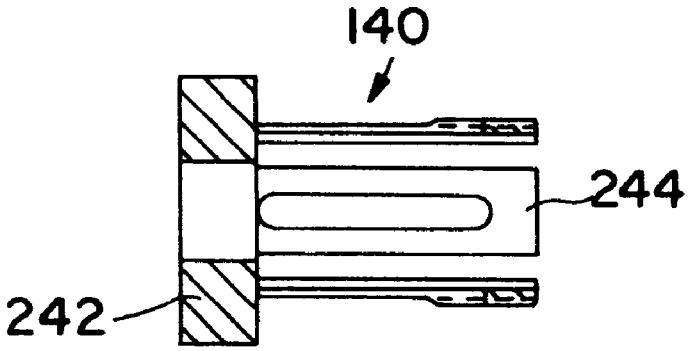
FIG. 2F illustrates a cross-sectional view of the bumper assembly of FIG. 1.

Referring now to FIG. 2F with continuing reference to FIG. 2C, illustrated is a cross-sectional view of the bumper assembly of FIG. 1. In a preferred embodiment, the bumper assembly 140 has a bumper 242 coupled to a plurality of collet members 244 and is positioned about the downhole portion 257 of the cone assembly 150.

Figure 2G:
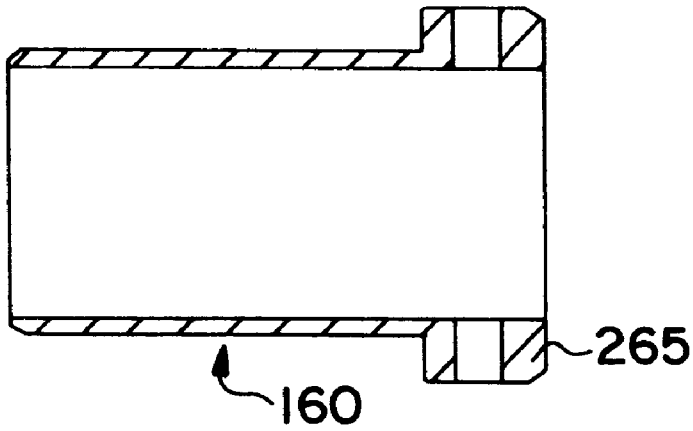
FIG. 2G illustrates a cross-sectional view of the downlock spring guide of FIG. 1.

Referring now to FIG. 2G with continuing reference to FIG. 2C, illustrated is a cross-sectional view of the downlock spring guide of FIG. 1. In a preferred embodiment, the downlock spring guide 160 is located about the downhole portion 257 of the cone assembly 150. The downlock spring guide 160 has a spring guide shoulder 265.

Referring now momentarily back to FIG. 1 with continuing reference to FIGS. 2A through 2G, in a preferred embodiment, the bumper assembly 140 is located about the extension rod 170, and is captured by the extension rod retainer 175. The bumper assembly 140 and extension rod 170 are positioned through the cage 133 with the lug 132 inserted in aperture 238. The bumper stop shoulder 134 of the lug cage 133 is captured between the downlock assembly spring 165 and the bumper 242. The extension rod 170 and extension rod retainer 175 extend through the spring guide 160 with the extension rod 170 and extension rod retainer 175 movable with respect to the spring guide 160. In the illustrated embodiment, the downlock assembly spring 165 is located circumferentially about the spring guide 160 and is captured between the downhole end of the bumper stop shoulder 134 and the spring guide shoulder 265. The spring guide shoulder 265 is captured by the spring guide stop shoulder 258 of the cone assembly 150.

Figure 3A:
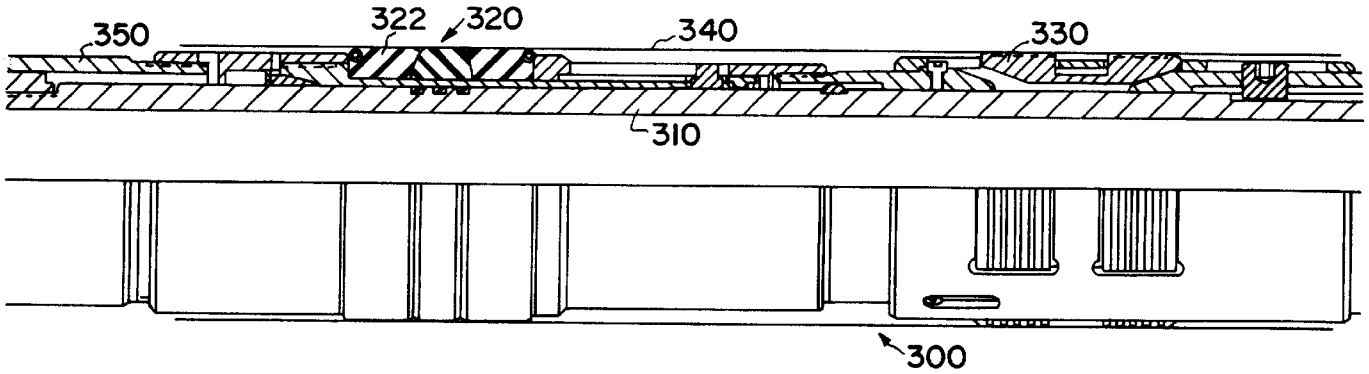
FIGS. 3A and 3B illustrate a cross-sectional view of an exemplary retrievable packer in the set position capable of being released by the packer releasing tool of FIG. 1.
Figure 3B:
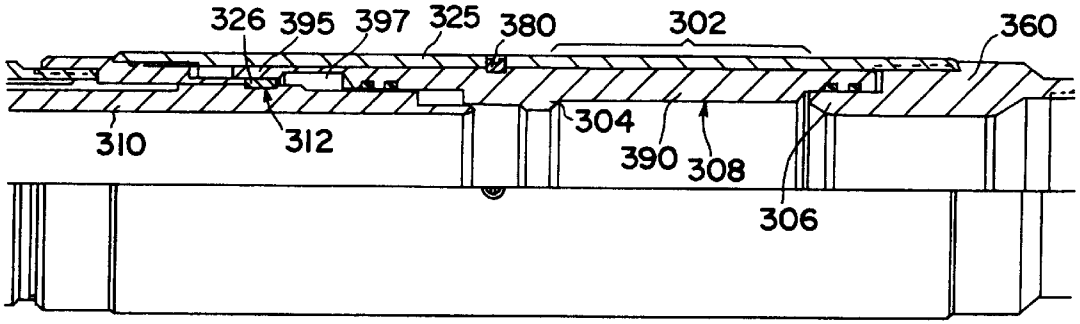

Referring now to FIGS. 3A and 3B, illustrated is a partial cross-sectional view of an exemplary retrievable packer in the set position capable of being released by the packer releasing tool of FIG. 1. A conventional retrievable packer, generally designated 300, comprises a packer mandrel 310, a primary packing seal 320, an outer sleeve 325, and a plurality of expandable slips 330. The primary packing seal 320 comprises a plurality of sealing elements 322 located radially about the circumference of the packer mandrel 310. The expandable slips 330 are distributed evenly about the circumference of the packer mandrel 310. One who is skilled in the art is familiar with the details of hydraulically-set well packers. The packer 300 is threadably coupled to sections of production tubing 350, 360 above and below the packer 300, respectively. In prior art, upper production tubing sections 350 would have to be removed to provide access for attachment of a conventional packer release tool.

The packer 300 further comprises a packer releasing profile 302, a snap ring 326, a shear screw 380, and a shift sleeve 390. The packer releasing profile 302 further comprises a packer uphole shoulder 304, a packer downhole shoulder 306, and a releasing profile inner surface 308. When expanded, the packing seal 320 is held in compression against a well casing 340 by the snap ring 326 located in a groove 312 about the packer mandrel 310. The snap ring 326 is held in the groove 312 by a shift sleeve extension 395 interposed between the snap ring 326 and the outer sleeve 325. The shear screw 380 holds the shift sleeve 390 in a fixed longitudinal position with respect to the outer sleeve 325. The shift sleeve 390 further comprises a shift sleeve recess 397 proximate the shift sleeve extension 395. To release a set packer 300, it is necessary to apply sufficient force to translate shift sleeve 390 uphole with respect to the outer sleeve 325, shearing shear screw 380 and locating the shift sleeve recess 397 radially about the snap ring 326. The snap ring 326 expands into the recess 397 and releases the packer mandrel 310.

Figure 4:
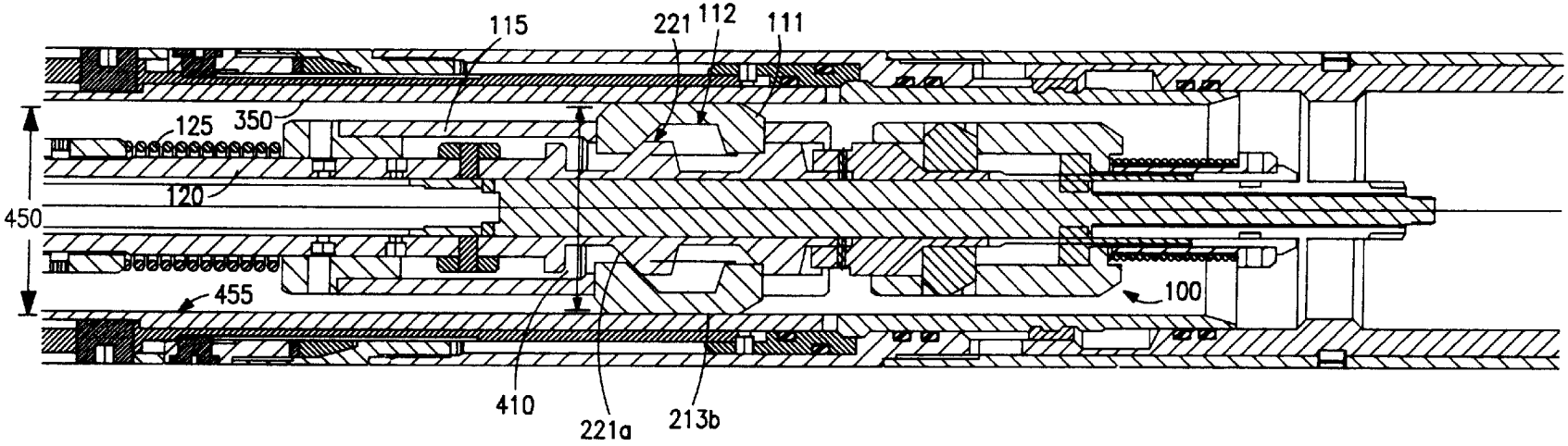
FIG. 4 illustrates a cross-sectional view of the packer releasing tool of FIG. 1 in the packer bore of FIG. 3.

Referring now to FIG. 4 with continuing reference to FIGS. 3A and 3B, illustrated is a cross-sectional view of the packer releasing tool of FIG. 1 in the packer bore. At the surface of the well, the toplock assembly spring 125 is compressed and the inner profile 112 of the toplock key 111 cooperatively engages the running profile 221 of the mandrel 120. In a preferred embodiment, the outside diameter 410 of the tool 100 is less than the inside diameter 450 of the production tubing 350. With the tool 100 inserted into the production tubing 350, the packer releasing tool 100 is deployed on the end of a wire line (not shown). One who is skilled in the art is familiar with oil field wire line tools and their employment. As the tool 100 travels through the tubing 350, the toplock assembly spring 125 urges the carrier 115 downhole with respect to the mandrel 120. As the carrier 115 moves downhole relative to the mandrel 120, a downhole force is transmitted to the toplock key 111 by the carrier 115. This tends to force the key 111 radially outward along the inclined surface 221*a* of the running profile 221. The outer surface 213*b* of the key 111 rides on the bore 455 of the production tubing 350.

Figure 5:
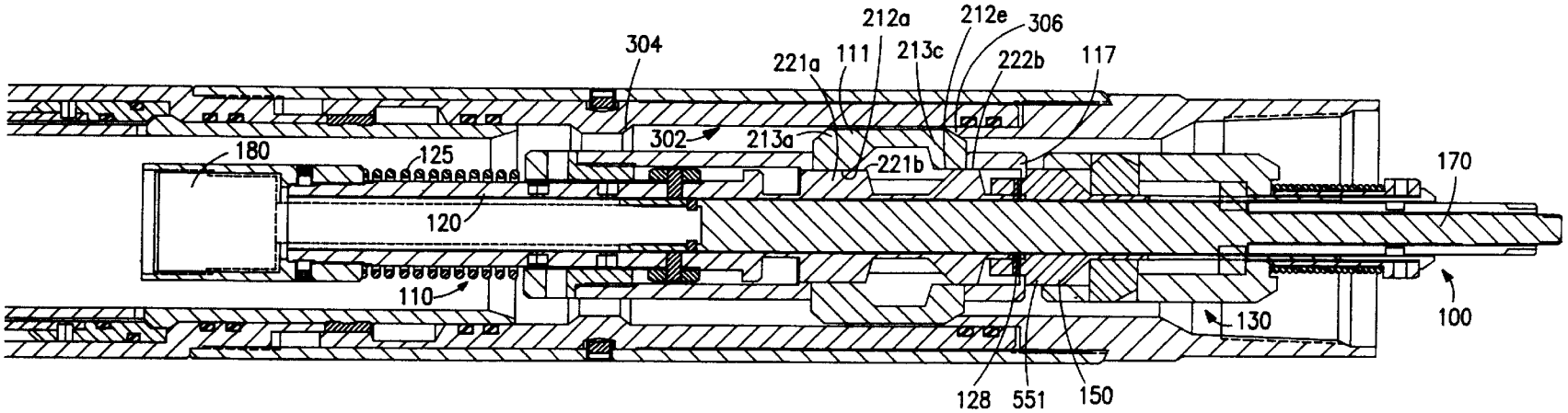
FIG. 5 illustrates a cross-sectional view of the packer releasing tool with the toplock key in contact with the downhole shoulder of the packer release profile.

Referring now to FIG. 5, illustrated is a cross-sectional view of the packer releasing tool with the toplock key in contact with the downhole shoulder of the packer release profile. In a preferred embodiment, as the key 111 of the tool 100 enters the packer release profile 302 the toplock assembly spring 125 urges the key 111 radially outward along inclined surface 221*a*. The key 111 continues radially outward until the inner surfaces 212*a*, 212*e* of the key 111 ride upon the outer surfaces 221*b*, 222*b* of the mandrel 120 as shown. The toplock assembly spring 125 further urges carrier 115 downhole until the carrier stop shoulder 117 of the carrier 115 contacts cone shoulder 551 on the downlock cone assembly 150.

As the tool 100 continues downhole proximate the packer releasing profile 302, the downhole stop shoulder 213*c* of the toplock key 111 contacts the packer downhole shoulder 306, and the tool 100 stops with the downhole stop shoulder 213*c* in contact with the packer downhole shoulder 306. Reduced tension in the slickline indicates that the tool is located in the packer releasing profile 302. Tension is applied to the slickline, rapidly lifting the tool 100 until toplock key uphole stop shoulder 213*a* contacts packer uphole shoulder 304 and with sufficient force to shear assembly shear pin 128. In an alternative embodiment, the tool 100 may be lifted until toplock key surface 213*a* contacts packer uphole shoulder 304, and the downhole power unit 180 is then used to shear the pin 128. The toplock assembly 110 and downlock assembly 130 are now movably coupled about the extension rod 170.

Figure 6:
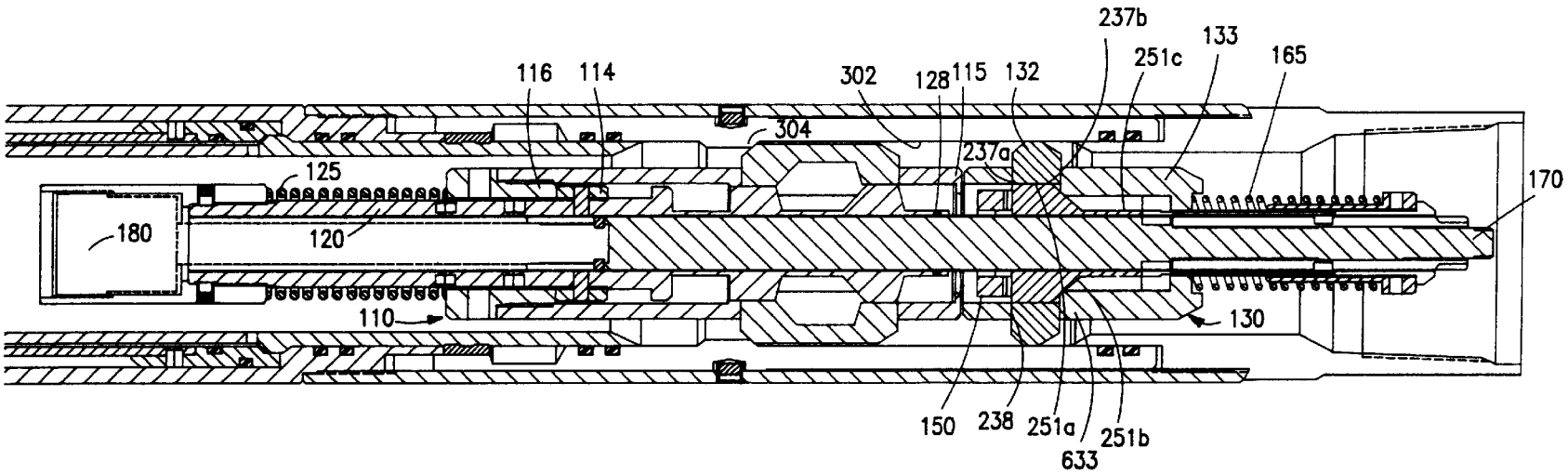
FIG. 6 illustrates a cross-sectional view of the packer releasing tool with the toplock key in contact with the uphole shoulder of the packer release profile.

Referring now to FIG. 6 with continuing reference to FIG. 5, illustrated is a cross-sectional view of the packer releasing tool with the toplock key in contact with the uphole shoulder of the packer release profile. In a preferred embodiment, when pin 128 is sheared both the toplock key carrier 115 and the downlock lug cage 133 move relative to the extension rod 170. These motions are in response to forces created by the toplock assembly spring 125 and the downlock spring 165, respectively. The toplock assembly spring 125 urges the toplock carrier 115 further downhole relative to the mandrel 120. The toplock carrier motion stops when carrier shoulder 116 contacts shear ring 114.

Likewise, when pin 128 is sheared, downlock spring 165 urges the downlock cone assembly 150 downhole relative to the downlock lug cage 133. The downlock lug 132 is forced uphole along outer profile surface 251*c* until downlock lug surface 237*a* contacts outer profile surface 251*b*. Further uphole motion by the downlock cage 133 causes the downlock lug 132 to ride up outer profile surface 251*b* and radially outward within lug cage aperture 238, thus extending into the packer releasing profile 302. As the lug cage 133 continues its uphole motion, the downlock lug 132 slides into a position such that lug surface 237*b* is in contact with cone assembly surface 251*a*. The lug cage motion ceases when downlock lug cage stop shoulder 633 contacts cone assembly surface 251*b*. With the toplock key uphole stop shoulder 213*a* in continuing contact with packer uphole shoulder 304, the downhole power unit 180 applies a downhole force to the downlock assembly 130 through extension rod 170, separating the toplock assembly 110 from the downlock assembly 130.

Figure 7:
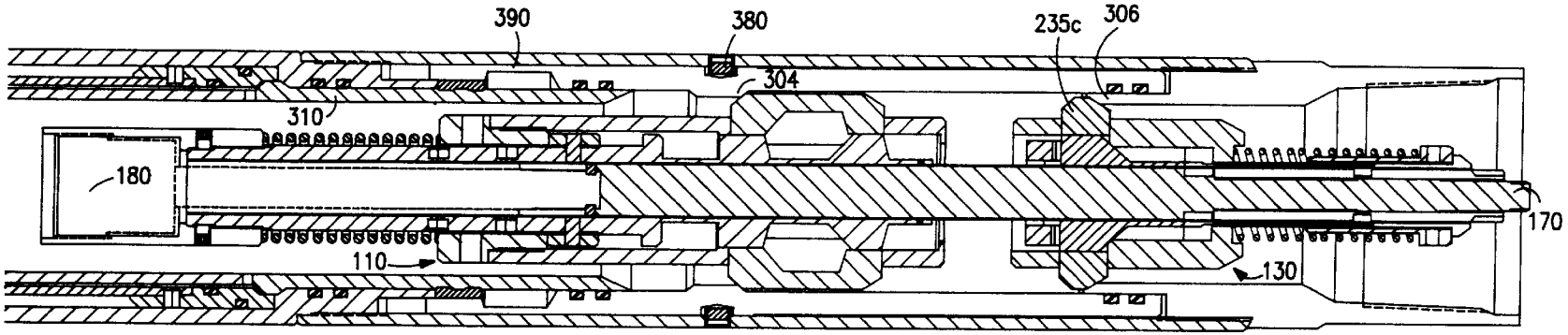
FIG. 7 illustrates a cross-sectional view of the packer releasing tool with the toplock key in contact with the uphole shoulder and the downlock lug in contact with the downhole shoulder of the packer release profile.

Referring now to FIG. 7, illustrated is a cross-sectional view of the packer releasing tool with the toplock key in contact with the uphole shoulder and the downlock lug in contact with the downhole shoulder of the packer release profile. In a preferred embodiment, the downhole power unit 180 continues to apply force to the extension rod 170, separating the toplock assembly 110 from the downlock assembly 130 until downlock lug downhole stop shoulder 235*c* contacts downhole shoulder 306. The continuing force applied by the downhole power unit 180 separates the uphole shoulder 304 and downhole shoulder 306 causing shear screw 380 to shear and allowing shift sleeve 390 to move uphole relative to the packer mandrel 310.

Figure 8:
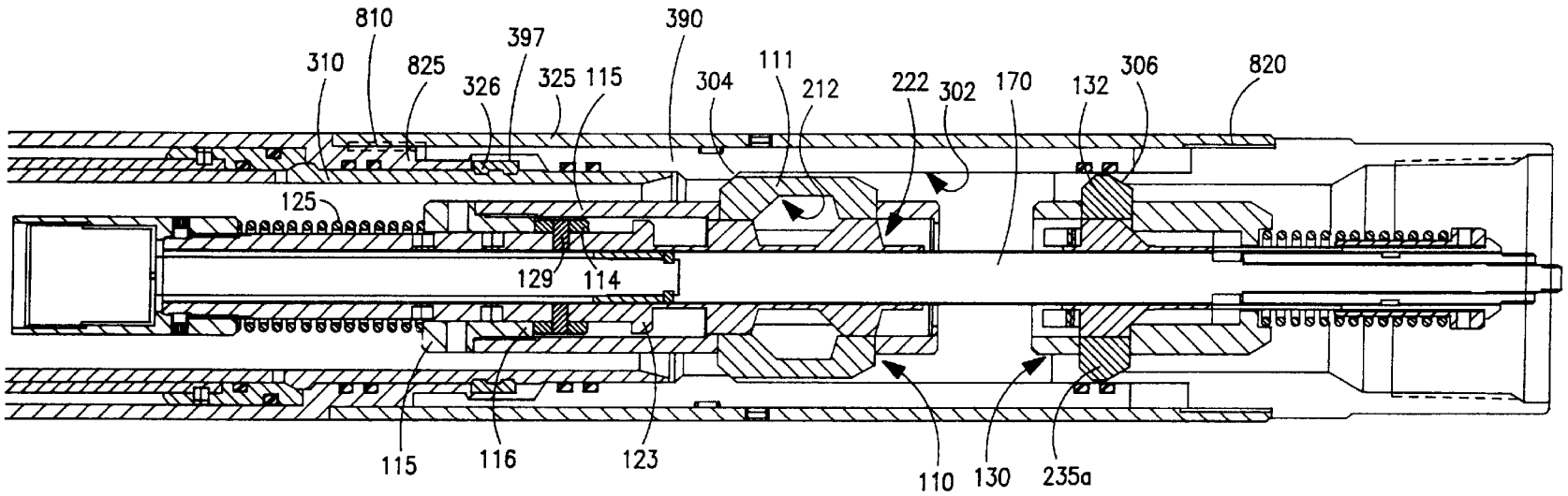
FIG. 8 illustrates a cross-sectional view of the packer releasing tool with the shift sleeve in contact with a shift sleeve stop shoulder.

Referring now to FIG. 8, illustrated is a cross-sectional view of the packer releasing tool with the shift sleeve in contact with a shift sleeve stop shoulder. In a preferred embodiment, the shift sleeve 390 moves uphole into contact with a shift sleeve stop shoulder 825 that is mechanically attached to the outer sleeve 325 through uphole threaded joint 810. The motion of the shift sleeve 390 positions the recess 397 about the snap ring 326. The snap ring 326 expands into the recess 397 and releases the packer mandrel 310 as described in FIG. 3. The outer sleeve 325 is also mechanically attached to the downhole shoulder 306 through downhole threaded joint 820. Thus, the packer uphole shoulder 304 and packer downhole shoulder 306 are prevented from further relative spreading motion by the outer sleeve 325.

The downhole power unit 180 continues to apply force through the extension rod 170 spreading the toplock assembly 110 and downlock assembly 130. Because the packer uphole shoulder 304 and packer downhole shoulder 306 are prevented from further relative motion, key 111 prevents carrier 115 from uphole motion, and induces a shear force concentrated at the key releasing shear pin 129. The key releasing shear pin 129 shears, and the top lock assembly spring 125 urges the carrier 115 downhole until the shear ring 114 is captured between the carrier shoulder 116 and the mandrel shoulder 123.

Figure 9:
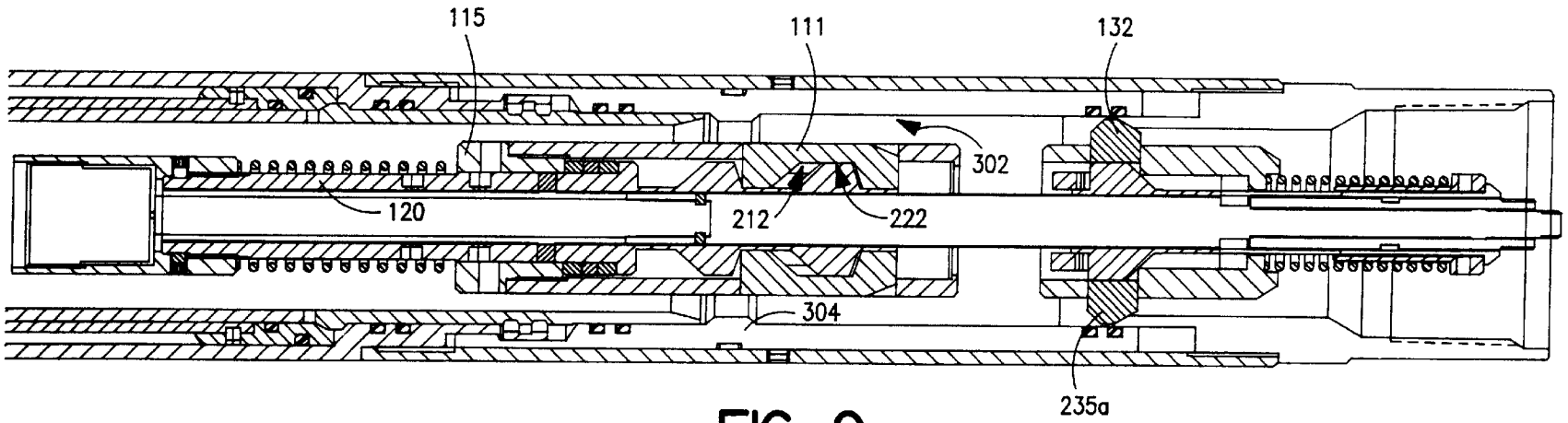
FIG. 9 illustrates a cross-sectional view of the packer releasing tool with the inner profile cooperating with the mandrel running profile.

Referring now to FIG. 9, illustrated is a cross-sectional view of the packer releasing tool with the inner profile cooperating with the mandrel running profile. As the carrier 115 moves downhole with respect to the mandrel 120, the carrier 115 urges the key 111 downhole until the key inner profile 212 cooperates with the carrier running profile 222 and the key 111 retracts about the mandrel 120. In a preferred embodiment, the tool 100 is pulled up in the packer releasing profile 302 until the downlock lug 132 contacts the packer uphole shoulder 304 at the uphole stop shoulder 235*a*.

Figure 10:
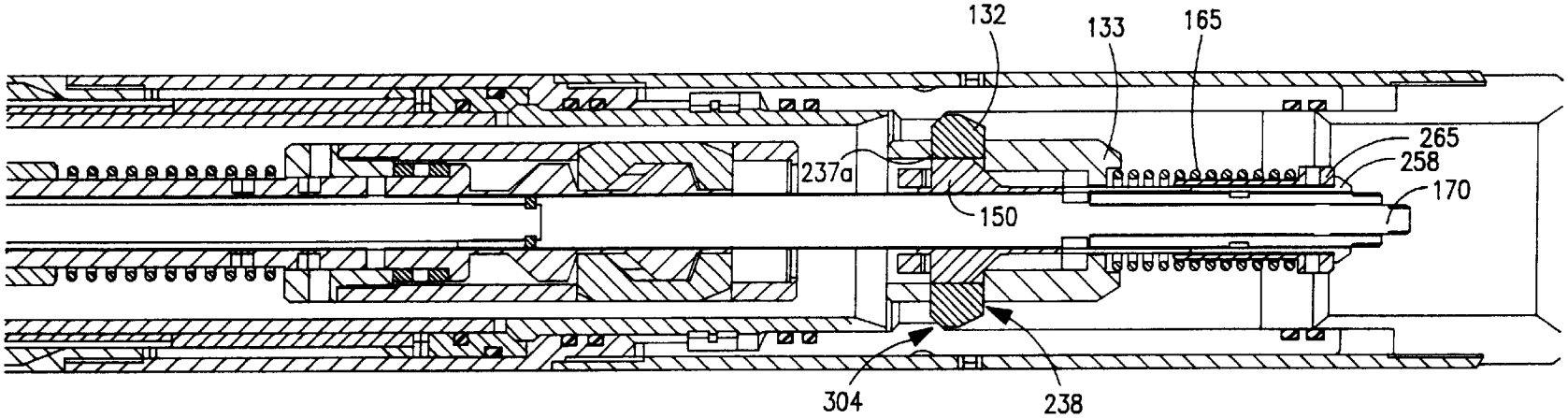
FIG. 10 illustrates a cross-sectional view of the packer releasing tool with the downlock lug in contact with the packer uphole shoulder.

Referring now to FIG. 10, illustrated is a cross-sectional view of the packer releasing tool with the downlock lug in contact with the packer uphole shoulder. In this location, the downlock lug cage 133 is prevented from further uphole motion. In a preferred embodiment, continued uphole force is transmitted through the extension rod 170, spring guide stop shoulder 258 and spring guide shoulder 265 that causes the downlock spring 165 to compress. The downlock cone assembly 150 is rigidly affixed to the extension rod 170 and moves uphole relative to the downlock lug cage 133. As the downlock cone assembly 150 moves uphole, the cone assembly 150 slides relative to lug 132 until lug surface 237*a* contacts outer profile surface 251*b*. As the cone assembly 150 continues uphole relative to the lug cage 133, downlock lug 132 rides down outer profile surface 251*b* within the downlock lug aperture 238, until the lug 132 clears packer uphole shoulder 304.

Figure 11:
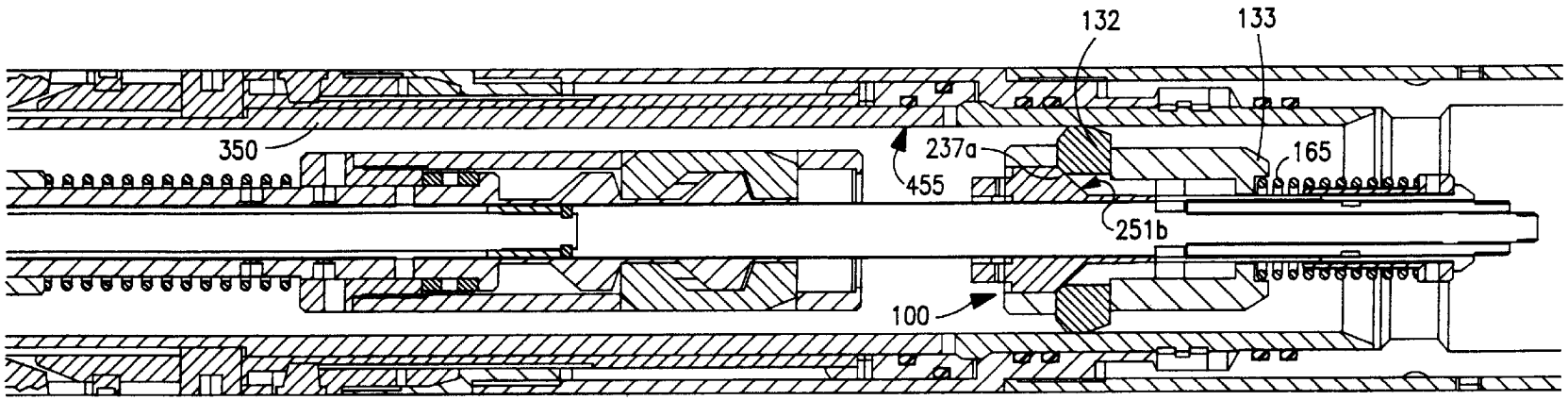
FIG. 11 illustrates a cross-sectional view of the packer releasing tool with the downlock lug retracted to a pulling position.

Referring now to FIG. 11, illustrated is a cross-sectional view of the packer releasing tool with the downlock lug retracted to a pulling position. As a continuing uphole pulling force is applied to the tool 100, the downlock spring 165 urges the downlock lug cage 133 uphole forcing downlock lug surface 237*a* into contact with cone assembly surface 251*b*. This force tends to urge the lug 132 toward the bore 455 of the production tubing 350. Thus, in a preferred embodiment, the lug 132 conforms to the varying bore diameters as the tool 100 is retrieved from the tubing string. Referring now briefly to FIGS. 3A and 3B, with the packer 300 released and the tool 100 removed, the entire production tubing 350, 360 and packer 300 assembly is removed from the wellbore.

From the above, it is apparent that the present invention provides a packer releasing tool for releasing a packer from a wellbore where the packer is coupled to a tubing string and has a releasing profile with a packer uphole shoulder and a packer downhole shoulder. The packer releasing tool preferably comprises a toplock assembly that is removably coupled to a downlock assembly and a toplock key that is movably coupled to the toplock assembly and that has a toplock key profile engageable against the packer releasing profile. This embodiment further includes a downlock lug that is movably coupled to the downlock assembly and that has a downlock lug profile engageable against the packer releasing profile. The packer releasing tool preferably has an outer diameter that is less than the inner diameter of the tubing string. This unique configuration allows the packer to be pulled without the need of first removing the production string.

Although the present invention has been described in detail, those who are skilled in the art should understand that they can make various changes, substitutions and alterations herein without departing from the spirit and scope of the invention in its broadest form.

What is claimed is:

1. For releasing a packer from a wellbore, said packer coupled to a tubing string and having a packer releasing profile with a packer uphole shoulder and a packer downhole shoulder, a packer releasing tool, comprising:

a toplock assembly removably coupled to a downlock assembly;

a toplock key movably coupled to said toplock assembly and having a toplock key profile engageable against said packer releasing profile; and a downlock lug movably coupled to said downlock assembly and having a downlock lug profile engageable against said packer releasing profile.

2. The packer releasing tool as recited in claim 1 wherein said toplock key includes an inner profile and said toplock assembly further comprises a running profile configured to cooperatively engage said inner profile and receive said toplock key therein as said packer releasing tool is run into said wellbore.

3. The packer releasing tool as recited in claim 2 wherein said toplock assembly further comprises a pulling profile configured to cooperatively engage said inner profile and receive said toplock key therein when said packer releasing tool is pulled from said wellbore.

4. The packer releasing tool as recited in claim 2 wherein said toplock assembly further comprises a toplock carrier and a mandrel, said toplock carrier movable with respect to said mandrel, and said toplock assembly further including a key releasing shear pin coupling said toplock carrier to said mandrel and holding said toplock carrier and said mandrel in a fixed positional relationship.

5. The packer releasing tool as recited in claim 4 wherein said mandrel includes a mandrel stop shoulder and said toplock carrier includes a carrier shoulder configured to engage said mandrel stop shoulder and prevent a movement of said toplock carrier with respect to said mandrel.

6. The packer releasing tool as recited in claim 4 further comprising a toplock assembly spring configured to exert a downhole force against said toplock carrier and move said toplock carrier downhole with respect to said mandrel to allow said inner profile to engage said pulling profile when said key releasing shear pin is sheared.

7. The packer releasing tool as recited in claim 1 wherein said toplock assembly is removably coupled to said downlock assembly by an assembly shear pin.

8. The packer releasing tool as recited in claim 7 wherein said assembly shear pin is configured to shear when a sufficient amount of force is exerted against said shear pin, and thereby allow said toplock assembly to separate from said downlock assembly.

9. The packer releasing tool as recited in claim 1 wherein said downlock assembly includes a downlock lug running profile configured to cooperatively receive said downlock lug therein as said packer releasing tool is run into said wellbore.

10. The packer releasing tool as recited in claim 1 wherein said toplock key profile includes a toplock key uphole stop shoulder configured to engage said packer uphole shoulder and a toplock key downhole stop shoulder configured to engage said packer downhole shoulder.

11. The packer releasing tool as recited in claim 1 wherein said downlock lug profile includes a downlock lug uphole stop shoulder configured to engage said packer uphole shoulder and a downlock lug downhole stop shoulder configured to engage said packer downhole shoulder.

12. The packer releasing tool as recited in claim 1 further comprising an extension rod extending through said toplock assembly and said downlock assembly, said extension rod movable with respect to said toplock assembly and engageable against said downlock assembly to separate said downlock assembly from said toplock assembly.

13. The packer releasing tool as recited in claim 12 further comprising a downhole power unit coupled to said extension rod and configured to exert a downhole force against said downlock assembly by way of said extension rod.

14. The packer releasing tool as recited in claim 12 further comprising:

an extension rod retainer coupled to said extension rod;

a spring guide having a spring guide shoulder and positioned about said extension rod retainer, said spring guide coupled to said downlock assembly, said extension rod extending through said extension rod retainer and said spring guide, said extension rod retainer movable with respect to said spring guide; and a downlock assembly spring, said downlock assembly spring positioned about said spring guide and captured between said spring guide shoulder and said downlock assembly.

15. The packer releasing tool as recited in claim 14 wherein said downlock assembly further comprises:

a cone assembly having an uphole portion and a downhole portion, said spring guide coupled to said cone assembly adjacent said downhole portion of said cone assembly, said downhole portion of said cone assembly including a spring guide stop shoulder;

a downlock lug cage movably coupled to said cone assembly and having a bumper stop shoulder, said spring guide shoulder engageable against said spring guide stop shoulder to capture said downlock assembly spring between said downlock lug cage and said spring guide shoulder; and a bumper assembly having a bumper coupled to collet members positioned about said downhole portion of said cone assembly, said bumper engageable against said bumper stop shoulder.

16. The packer releasing tool as recited in claim 1 wherein said packer releasing tool has an outer diameter less than an inner diameter of said tubing string such that it may pass through said tubing string.

17. A system for releasing a packer from a wellbore, comprising, a packer coupled to a tubing string and having a packer releasing profile with a packer uphole shoulder and a packer downhole shoulder;

a packer releasing tool, comprising;

a toplock assembly removably coupled to a downlock assembly;

a toplock key movably coupled to said toplock assembly and having a toplock key profile engageable against said packer releasing profile;

a downlock lug movably coupled to said downlock assembly and having a downlock lug profile engageable against said packer releasing profile, said packer releasing tool having an outer diameter less than an inner diameter of said tubing string such that it may pass through said tubing string; and a downhole power unit couplable to said packer releasing tool.

18. The system as recited in claim 17 wherein said toplock key includes an inner profile and said toplock assembly further comprises a running profile configured to cooperatively engage said inner profile and receive said toplock key therein as said packer releasing tool is run into said wellbore.

19. The system as recited in claim 17 wherein said toplock assembly further comprises a pulling profile configured to cooperatively engage said inner profile and receive said toplock key therein when said packer releasing tool is pulled from said wellbore.

20. The system as recited in claim 17 wherein said toplock assembly further comprises a toplock carrier and a mandrel, said toplock carrier movable with respect to said mandrel, and said toplock assembly further includes a key releasing shear pin coupling said toplock carrier to said mandrel and holding said toplock carrier and said mandrel in a fixed positional relationship.

21. The system as recited in claim 20 wherein said mandrel includes a mandrel stop shoulder and said toplock carrier includes a carrier shoulder configured to engage said mandrel stop shoulder and prevent a movement of said toplock carrier with respect to said mandrel.

22. The system as recited in claim 20 further comprising a toplock assembly spring configured to exert a downhole force against said toplock carrier and move said toplock carrier downhole with respect to said mandrel and allow said inner profile to engage said pulling profile when said key releasing shear pin is sheared.

23. The system as recited in claim 17 wherein said toplock assembly is removably coupled to said downlock assembly by an assembly shear pin.

24. The system as recited in claim 23 wherein said assembly shear pin is configured to shear when a sufficient amount of force is exerted against said shear pin, and thereby allow said toplock assembly to separate from said downlock assembly.

25. The system as recited in claim 17 wherein said downlock assembly includes a downlock lug running profile configured to cooperatively receive said downlock lug therein as said packer releasing tool is run into said wellbore.

26. The system as recited in claim 17 wherein said toplock key profile includes a toplock key uphole stop shoulder configured to engage said packer uphole shoulder and a toplock key downhole stop shoulder configured to engage said packer downhole shoulder.

27. The system as recited in claim 17 wherein said downlock lug profile includes a downlock lug uphole stop shoulder configured to engage said packer uphole shoulder and a downlock lug downhole stop shoulder configured to engage said packer downhole shoulder.

28. The system as recited in claim 17 further comprising an extension rod extending through said toplock assembly and said downlock assembly, said extension rod movable with respect to said toplock assembly and engageable against said downlock assembly to separate said downlock assembly from said toplock assembly.

29. The system as recited in claim 28 wherein said downhole power unit is coupled to said extension rod and configured to exert a downhole force against said downlock assembly by way of said extension rod.

30. The system as recited in claim 28 further comprising:

an extension rod retainer coupled to said extension rod;

a spring guide having a spring guide shoulder and positioned about said extension rod retainer, said spring guide coupled to said downlock assembly, said extension rod extending through said extension rod retainer and said spring guide, said extension rod retainer movable with respect to said spring guide; and a downlock assembly spring, said downlock assembly spring positioned about said spring guide and captured between said spring guide shoulder and said downlock assembly.

31. The system as recited in claim 17 wherein said downlock assembly further comprises:

a cone assembly having an uphole portion and a downhole portion, said spring guide coupled to said cone assembly adjacent said downhole portion of said cone assembly, said downhole portion of said cone assembly including a spring guide stop shoulder;

a downlock lug cage movably coupled to said cone assembly and having a bumper stop shoulder, said spring guide shoulder engageable against said spring guide stop shoulder to capture said downlock assembly spring between said downlock lug cage and said spring guide shoulder; and a bumper assembly having a bumper coupled to collet members positioned about said downhole portion of said cone assembly, said bumper engageable against said bumper stop shoulder.

32. The system as recited in claim 17 wherein said packer includes packer seals and packer slips engageable against an inner diameter of said wellbore.

33. The system as recited in claim 32 wherein said packer further includes a snap ring and a snap ring mandrel, said snap ring mandrel having a slideable packer sleeve associated therewith to maintain said snap ring in a retracted position, said snap ring configured to maintain said packer seal and packer slips in an engaged position against said inner diameter of said wellbore when said snap ring is in said retracted position.

34. The system as recited in claim 33 wherein said packer releasing tool is engageable against said uphole shoulder to shift said packer sleeve with respect to said snap ring, thereby to allow said snap ring to move from said retracted position to a release position and allow said packer seal and said packer slips to disengage from said inner diameter of said wellbore.

35. The system as recited in claim 17 wherein said packer releasing tool has an outer diameter less than an inner diameter of said tubing string such that it may pass through said tubing string.

36. For releasing a packer from a wellbore, said packer coupled to a tubing string and having a packer releasing profile with a packer uphole shoulder and a packer downhole shoulder, a packer releasing tool, comprising:

a toplock assembly removably coupled to a downlock assembly, said toplock assembly having a running profile;

a toplock key movably coupled to said toplock assembly and having a toplock key profile engageable against said packer releasing profile, said toplock key further having an inner profile, said running profile configured to cooperatively engage said inner profile and receive said toplock key therein as said packer releasing tool is run into said wellbore; and a downlock lug movably coupled to said downlock assembly and having a downlock lug downhole stop shoulder engageable against said downhole shoulder, said downlock lug profile including a running profile configured to cooperatively receive said downlock lug therein as said packer releasing tool is run into said wellbore, said packer releasing tool having an outer diameter less than an inner diameter of said tubing string such that it may pass through said tubing string.

37. The packer releasing tool as recited in claim 36 wherein said toplock assembly is removably coupled to said downlock assembly by an assembly shear pin.

38. The packer releasing tool as recited in claim 37 wherein said assembly shear pin is configured to shear when a sufficient amount of force is exerted against said shear pin, and thereby allow said toplock assembly to separate from said downlock assembly.

39. The packer releasing tool as recited in claim 36 wherein said toplock key includes an inner profile and said toplock assembly further comprises a pulling profile configured to cooperatively engage said inner profile and receive said toplock key therein when said packer releasing tool is pulled from said wellbore.

40. The packer releasing tool as recited in claim 39 wherein said toplock assembly further comprises a toplock carrier and a mandrel, said toplock carrier movable with respect to said mandrel, and said toplock assembly further includes a key releasing shear pin coupling said toplock carrier to said mandrel and holding said toplock carrier and said mandrel in a fixed positional relationship.

41. The packer releasing tool as recited in claim 40 wherein said mandrel includes a mandrel stop shoulder and said toplock carrier includes a carrier shoulder configured to engage said mandrel stop shoulder and prevent a movement of said toplock carrier with respect to said mandrel.

42. The packer releasing tool as recited in claim 40 further comprising a toplock assembly spring configured to exert a downhole force against said toplock carrier and move said toplock carrier downhole with respect to said mandrel and allow said inner profile to engage said pulling profile when said key releasing shear pin is sheared.

43. The packer releasing tool as recited in claim 36 wherein said toplock key profile includes a toplock key uphole no-go shoulder configured to engage said packer uphole shoulder and a toplock key downhole no-go shoulder configured to engage said packer downhole shoulder.

44. The packer releasing tool as recited in claim 36 wherein said downlock lug profile includes a downlock lug uphole no-go shoulder configured to engage said packer uphole shoulder and a downlock lug downhole no-go shoulder configured to engage said packer downhole shoulder.

45. The packer releasing tool as recited in claim 36 further comprising an extension rod extending through said toplock assembly and said downlock assembly, said extension rod movable with respect to said toplock assembly and engageable against said downlock assembly to separate said downlock assembly from said toplock assembly.

46. The packer releasing tool as recited in claim 45 further comprising a downhole power unit coupled to said extension rod and configured to exert a downhole force against said downlock assembly by way of said extension rod.

47. The packer releasing tool as recited in claim 45 further comprising:

an extension rod retainer fixedly coupled to said extension rod;

a spring guide having a spring guide shoulder and positioned about said extension rod retainer, said spring guide fixedly coupled to said downlock assembly, said extension rod extending through said extension rod retainer and said spring guide, said extension rod retainer movable with respect to said spring guide; and a downlock assembly spring, said downlock assembly spring positioned about said spring guide and captured between said spring guide shoulder and said downlock assembly.

48. The packer releasing tool as recited in claim 47 wherein said downlock assembly further comprises:

a cone assembly having an uphole portion and a downhole portion, said spring guide coupled to said cone assembly adjacent said downhole portion of said cone assembly, said downhole portion of said cone assembly including a spring guide stop shoulder;

a downlock lug cage movably coupled to said cone assembly and having a bumper stop shoulder, said spring guide shoulder engageable against said spring guide stop shoulder to capture said downlock assembly spring between said downlock lug cage and said spring guide shoulder; and a bumper assembly having a bumper coupled to collet members positioned about said downhole portion of said cone assembly, said bumper assembly engageable against said bumper stop shoulder.

49. A method for releasing a packer from a wellbore, said packer coupled to a tubing string and having a packer releasing profile with a packer uphole shoulder and a packer downhole shoulder, comprising:

positioning a packer releasing tool within a packer positioned in a wellbore, said packer releasing tool having a toplock assembly removably coupled to a downlock assembly;

engaging a toplock key profile of said toplock assembly against said packer releasing profile;

engaging a downlock lug profile of said downlock assembly against said packer releasing profile; and releasing said packer from said wellbore.

50. The method as recited in claim 49 wherein said positioning includes engaging an inner profile of said toplock key against a running profile of said toplock assembly to receive said toplock key within said running profile as said packer releasing tool is positioned within said packer.

51. The method as recited in claim 50 wherein said method includes pulling said releasing tool from said wellbore and said pulling includes engaging an inner profile of said toplock key with said inner pulling profile and receiving said toplock key in said inner pulling profile when said packer releasing tool is pulled from said wellbore.

52. The method as recited in claim 49 wherein said toplock assembly includes a toplock carrier and a mandrel coupled by a key releasing shearing pin and said method further includes:

shearing said key releasing shear pin, thereby to allow said mandrel to move with respect to said toplock carrier;

shifting said mandrel with respect to said toplock carrier;

receiving said toplock key within said inner pulling profile of said mandrel; and releasing said toplock key from said packer releasing profile.

53. The method as in claim 52 wherein said mandrel includes a mandrel stop shoulder and said toplock carrier includes a carrier shoulder and said shifting includes engaging said carrier shoulder against said mandrel stop shoulder to prevent a further movement of said toplock carrier with respect to said mandrel.

54. The method as recited in claim 52 wherein said toplock assembly further comprises a toplock assembly spring and said shearing includes exerting a downhole force against said toplock carrier with said toplock assembly spring and moving said toplock carrier downhole with respect to said mandrel to allow said inner profile to engage said pulling profile when said key releasing shear pin is sheared.

55. The method as recited in claim 49 wherein said toplock assembly is removably coupled to said downlock assembly by an assembly shear pin.

56. The method as recited in claim 55 wherein said:

engaging said toplock key profile and said downlock lug profile includes exerting a sufficient amount of force against said shear pin to shear said shear pin; and separating said toplock assembly from said downlock assembly.

57. The method as recited in claim 49 wherein said positioning includes receiving said downlock lug within a downlock lug running profile of said downlock assembly as said packer releasing tool is run into said wellbore.

58. The method as recited in claim 49 wherein said toplock key profile includes a toplock key uphole stop shoulder and a toplock key downhole stop shoulder said engaging toplock key profile of said toplock assembly against said packer releasing profile includes engaging said toplock key downhole stop shoulder against said packer downhole shoulder and engaging said toplock key uphole stop shoulder against said packer uphole shoulder.

59. The method as recited in claim 49 wherein said downlock lug profile includes a downlock lug uphole stop shoulder and a downlock lug downhole stop shoulder and said method of engaging said packer releasing profile includes engaging said downlock lug downhole stop shoulder against said packer downhole shoulder and engaging said downlock lug uphole stop shoulder against said packer uphole shoulder.

60. The method as recited in claim 49 wherein said packer releasing tool further comprises an extension rod extending through said toplock assembly and said downlock assembly, said extension rod movable with respect to said toplock assembly and said engaging packer releasing profile includes engaging said extension rod against said downlock assembly and separating said downlock assembly from said toplock assembly.

61. The method as recited in claim 60 wherein said separating includes exerting a force against said extension rod with a downhole power unit coupled to said extension rod.

62. The method as recited in claim 49 wherein said releasing said packer includes engaging said packer releasing tool against said uphole shoulder and shifting a packer sleeve with respect to a packer snap ring, thereby to allow said snap ring to move from a retracted position to a release position and allow packer seals and packer slips to disengage from an inner diameter of said wellbore.

63. The method as recited in claim 49 wherein said packer releasing tool has an outer diameter less than an inner diameter of said tubing string such that it may pass through said tubing string and said method further comprises running said packer releasing tool through said tubing string and removing said packer and said tubing string simultaneously from said wellbore.

* * * * *